US006523921B2

(12) United States Patent
Codos

(10) Patent No.: US 6,523,921 B2
(45) Date of Patent: Feb. 25, 2003

(54) METHOD AND APPARATUS FOR PRINTING ON RIGID PANELS AND OTHER CONTOURED OR TEXTURED SURFACES

(75) Inventor: Richard N. Codos, Warren, NJ (US)

(73) Assignee: L&P Property Management, South Gate, CA (US)

( * ) Notice: Subject to any disclaimer, the term of this patent is extended or adjusted under 35 U.S.C. 154(b) by 0 days.

(21) Appl. No.: 09/822,795

(22) Filed: Mar. 30, 2001

(65) Prior Publication Data

US 2002/0024544 A1 Feb. 28, 2002

Related U.S. Application Data

(63) Continuation-in-part of application No. 09/650,596, filed on Aug. 30, 2000.

(51) Int. Cl.[7] ..... B41J 25/308
(52) U.S. Cl. ..... 347/8; 347/37
(58) Field of Search ..... 347/8, 4, 43; 400/55–60

(56) References Cited

U.S. PATENT DOCUMENTS

| | | | | |
|---|---|---|---|---|
| 4,118,264 | A | | 10/1978 | Boettcher |
| 4,197,563 | A | | 4/1980 | Michaud |
| 5,193,918 | A | * | 3/1993 | Lohmann et al. ..... 400/56 |
| 5,396,275 | A | | 3/1995 | Koike et al. |
| 5,455,607 | A | * | 10/1995 | Rhoads ..... 347/8 |
| 5,505,994 | A | | 4/1996 | Crawford |
| 5,693,688 | A | * | 12/1997 | Priou ..... 522/25 |
| 5,757,389 | A | * | 5/1998 | Schwede et al. ..... 347/4 |
| 5,774,155 | A | | 6/1998 | Medin et al. |
| 5,831,641 | A | | 11/1998 | Carlson |
| 5,854,643 | A | | 12/1998 | Katsuyama |
| 5,859,653 | A | * | 1/1999 | Aoki et al. ..... 347/8 |
| 5,873,315 | A | * | 2/1999 | Codos ..... 112/117 |
| 5,887,992 | A | | 3/1999 | Yamanashi |
| 5,940,092 | A | | 8/1999 | Kashimura et al. |
| 5,975,666 | A | * | 11/1999 | Kawaguchi ..... 347/8 |
| 5,980,132 | A | | 11/1999 | Kawai |
| 5,988,784 | A | | 11/1999 | Takemura et al. |
| 6,000,775 | A | | 12/1999 | Muraki |
| 6,012,403 | A | | 1/2000 | Codos et al. |
| 6,076,909 | A | | 6/2000 | Saeki et al. |
| 6,092,890 | A | | 7/2000 | Wen et al. |
| 6,102,590 | A | * | 8/2000 | Harris et al. ..... 400/56 |
| 6,145,979 | A | * | 11/2000 | Caiger et al. ..... 347/102 |

FOREIGN PATENT DOCUMENTS

| | | | |
|---|---|---|---|
| GB | 2322597 | | 9/1998 |
| JP | 361164836 | * | 7/1986 |
| JP | 62092849 | | 9/1987 |

* cited by examiner

*Primary Examiner*—Thinh Nguyen
*Assistant Examiner*—Ly T Tran
(74) *Attorney, Agent, or Firm*—Wood, Herron & Evans, L.L.P.

(57) ABSTRACT

Ink jet printing is provided onto rigid panels such as office partitions, which have surfaces that are contoured, textured or made of another three-dimensional material, or are otherwise differently spaced from the plane of the panel such that the distance between a printing element and the point on the surface on which ink is to be deposited is not always the same or exactly predictable. Preferably, three dimensional covered panels are printed using ink jet printing, preferably using ultraviolet (UV) light curable ink, which is first, at least partially cured with UV light and then subjected to heating to more completely cure and dry the ink to remove, by evaporation, further curing or otherwise, the uncured monomers. The panel surface may be contoured by quilting or molding processes. Print head to panel spacing is adjustable to maintain a predetermined constant distance from the printing element to the surface of the panel where the ink is to be applied. Each of a plurality of print heads is provided and independently moveable to control the spacing of the print heads from the substrate surface. Sensors on the print head carriage measure the shape, or vertical position of the print heads. The position or focal length of the UV light curing head may also be varied to maintain focus of the UV light on the ink on a contoured surface of the substrate.

34 Claims, 4 Drawing Sheets

METHOD AND APPARATUS FOR PRINTING ON RIGID PANELS AND OTHER CONTOURED OR TEXTURED SURFACES

This is a continuation-in-part of commonly assigned and copending U.S. patent application Ser. No. 09/650,596, filed Aug. 30, 2000, hereby expressly incorporated by reference herein.

This application is also related to commonly assigned U.S. patent application Ser. No. 09/390,571, filed Sep. 3, 1999, now U.S. Pat. No. 6,312,123 and International Application Ser. No. PCT/US00/24226, filed Sep. 1, 2000, both hereby expressly incorporated by reference herein.

This application is further related to the following commonly assigned series of patent applications: U.S. patent application Ser. No. 09/649,471, filed Aug. 28, 2000, now U.S. Pat. No. 6,263,816, entitled "Mattress Cover Printing and Quilting System and Method", which is a Continuation-In-Part of U.S. patent application Ser. No. 09/480,094, filed Jan. 10, 2000, entitled "Printing and Quilting Method and Apparatus Useful for Automated Multi-needle Quilting and Printing onto Webs", now U.S. Pat. No. 6,158,366, which is a Continuation-In-Part of U.S. patent application Ser. No. 09/250,352, filed Feb. 16, 1999, entitled "Combination Printing And Quilting Method And Apparatus", now U.S. Pat. No. 6,012,403; which is a Continuation-In-Part of similarly titled U.S. patent application Ser. No. 09/070,948, filed May 1, 1998, now U.S. Pat. No. 5,873,315, all of which are hereby expressly incorporated by reference herein.

FIELD OF THE INVENTION

The present invention relates to printing onto textured, contoured or other three-dimensional substrates. The invention is particularly related to the printing onto such substrates as those having textile fabric surfaces or molded objects, rigid panels such as office partitions, automobile interior panels and other contoured objects, and to such printing using ink jet printing techniques.

BACKGROUND OF THE INVENTION

Applying ink to a substrate by ink jet printing requires a proper spacing between the ink jet nozzles and the surface of the substrate to which the printing is applied. Normally, this spacing must be set to within one or two millimeters to maintain effective printing by an ink jet process. If the distance from the nozzles to the surface being printed is too great, deviations from ideal parallel paths of the drops from different nozzles become magnified. Further, the longer the flight path of the drops from the print head to the substrate, the more dependent the accuracy of the printing becomes on the relative speed between the print head and the substrate. This dependency limits the rate of change in print head to substrate velocity, including changes in direction. Also, the velocity of the drops moving from the print head nozzles to the substrate declines with the distance traveled from the nozzles, and the paths of such drops become more greatly affected by air currents and other factors with increased nozzle to substrate distance. Additionally, droplet shape changes the farther the drop moves from the nozzle, which changes the effects of the drop on the substrate. Accordingly, variations in the distance from the print head to the substrate can cause irregular effects on the printed image.

In addition to problems in jetting ink onto contoured surfaces, the curing of UV inks that requires sharply focused UV energy to deliver sufficient curing energy to the ink is difficult to achieve where the surface is contoured.

For the reasons stated above, ink jet printing has not been successful on contoured materials and other three-dimensional substrates, particularly printing with UV curable inks in ink jet printing processes.

SUMMARY OF THE INVENTION

An objective of the present invention is to provide for the printing onto three-dimensional substrates, particularly onto highly textured fabrics, tufted or irregular fabrics and other materials, contoured surfaces such as quilts, and mattress covers, and onto molded, stamped and otherwise shaped rigid or semi-rigid materials, and other three-dimensional surfaces. A particular objective of the invention is to print onto such surfaces with ink jet or digital printing processes. One more particular objective of the invention is to print onto such substrates with UV curable inks.

According to the principles of the present invention, printed images are applied to three-dimensional substrates with printing elements that are moveable relative to the plane of the substrate being printed. In certain embodiments, the invention provides a wide-substrate ink jet printing apparatus with print heads that move toward and away from the plane of a substrate to maintain a fixed distance between the nozzles of the printhead and the surface onto which the ink is being jetted. The variable distance over the plane of the substrate allows a controlled and uniform distance across which the ink is jetted.

In one preferred embodiment of the invention, the printing element is an ink jet print head set having a plurality of heads, typically four, each for dispensing one of a set of colors onto the substrate to form a multi-colored image. To maintain the constant distance or to otherwise control the distance, one or more sensors is provided to measure the distance from the print head or from the print head carriage track to the point on the substrate on which ink is to be projected. The sensors generate reference signals that are fed to a controller that controls a servo motor on the print head carriage. The print head is moveably mounted to the carriage, for example on a ball screw mechanism, and is moveable toward and away from the plane of the substrate by operation of the servo motor.

In a preferred embodiment of the invention, each print head of a set of four different color print heads is separately moveable relative to a common print head carriage, and is connected to one of a set of four servo motors by which its position relative to the plane of the substrate is capable of control relative to the positions of the other print heads. The print heads of the set are preferably arranged side by side in the transverse direction on the carriage so that one head follows the other across the width of the substrate as the carriage scans transversely across the substrate. Each head has a plurality of ink jet nozzles thereon for dispensing a given color of ink in a corresponding plurality of dots, for example 128 in number, that extend in a line transverse to the carriage, which is in a longitudinal direction perpendicular to the scan direction of the carriage. Two laser or optical sensors are provided on the carriage, one on each side of the heads, so that a distance measurement of the surface to the substrate can be taken ahead of the print heads when the heads are scanning in either direction. The controller records the contour of the substrate ahead of the print heads and varies the position of each print head, toward and away from the substrate plane, as each print head passes over the points at which the measurements were taken, so that each of the independently moveable heads follows the contour and maintains a fixed distance from the surface being printed.

While it is preferred to adjust the position of the print head or nozzle thereof relative to the substrate which is fixed on a printing machine frame, the substrate surface can alternatively be positioned relative to a print head that is maintained at a fixed vertical position on the frame.

Preferably, UV ink is printed onto material and the cure of the ink is initiated by exposure to UV light. UV curing lights may be mounted on the print head carriage, one on each side of the print head set, to expose the printed surface behind the heads. With or following the exposure to the UV light, the printed textile substrates or other textured or porous fabric is subjected to heat, preferably by blowing heated air onto the material downstream of the printing station, which extends the UV light initiated curing process and removes uncured components of the ink. With quilted bedding fabric materials, UV curable ink is jetted onto the fabric and the jetted ink is exposed to UV curing light to cure the ink preferably to about 90 to 97% polymerization, with the fabric bearing the partially cured, jetted ink then heated in a hot air blower curing oven at which the UV light initiated polymerization continues, uncured monomers are vaporized, or both, in order to produce a printed image of UV ink that contains a low quantity of uncured monomer or other ink components, for example, less than 0.01%.

Where UV ink is jetted onto a highly textured fabric such as a mattress cover ticking material, the ink is jetted at a dot density of from about 180×254 dots per inch per color to about 300×300 dots per inch per color. For certain common UV inks, four colors of a CMYK color palette are applied, each in drops or dots of, for example, about 75 picoliters, or approximately 80 nanograms, per drop, utilizing a UV ink jet print head. A UV curing light head is provided, which moves either with the print head or independent of the print head and exposes the deposited drops of UV ink with a beam of about 300 watts per linear inch, applying about 1 joule per square centimeter, thereby producing at least a 90% UV cure. The fabric on which the jetted ink has been thereby partially UV cured is then passed through an oven where it is heated to about 300° F. for from about 30 seconds up to about three minutes. Forced hot air is preferably used to apply the heat in the oven, but other heating methods such as infrared or other radiant heaters may be used. Similar parameters may be used for cloth covered rigid panels such as office partitions.

When printing onto contoured material, the distance from the print heads to the substrate where the ink is to be deposited can be determined by measuring the distance from a sensor to the substrate ahead of the print heads and mapping the location of the surface. For bidirectional print heads that move transversely across the longitudinally advancing fabric, providing two distance measuring sensors, one on each of the opposite sides of the print heads, are provided to measure the distance to the contoured fabric surface when the print heads are moving in either direction. For some inks and for sufficiently rigid materials, a mechanical rolling sensor may be used, for example, by providing a pair of rollers, with one roller ahead of, and one head behind, the print head so that the average distance between the two rollers and a reference point on the print head can be used to control the distance of the print head from the plane of the substrate. To achieve this, one or more print heads can be mounted to a carriage having the rollers on the ends thereof so that the mechanical link between the rollers moves the print head relative to the plane of the substrate. In most cases, a non-contact sensor, such as a laser or photo eye sensor, is preferred in lieu of each roller. The outputs of two sensors on opposite sides of the print heads can be communicated to a processor, to measure the distance from the heads to the fabric ahead of the bidirectional heads, to drive a servo motor connected to the print head to raise and lower the head relative to the substrate plane so that the print heads move parallel to the contoured surface and jet ink onto the fabric across a fixed distance.

These and other objects of the present invention will be more readily apparent from the following detailed description of the preferred embodiments of the invention.

DETAILED DESCRIPTION OF THE PREFERRED EMBODIMENT

Figure 1:
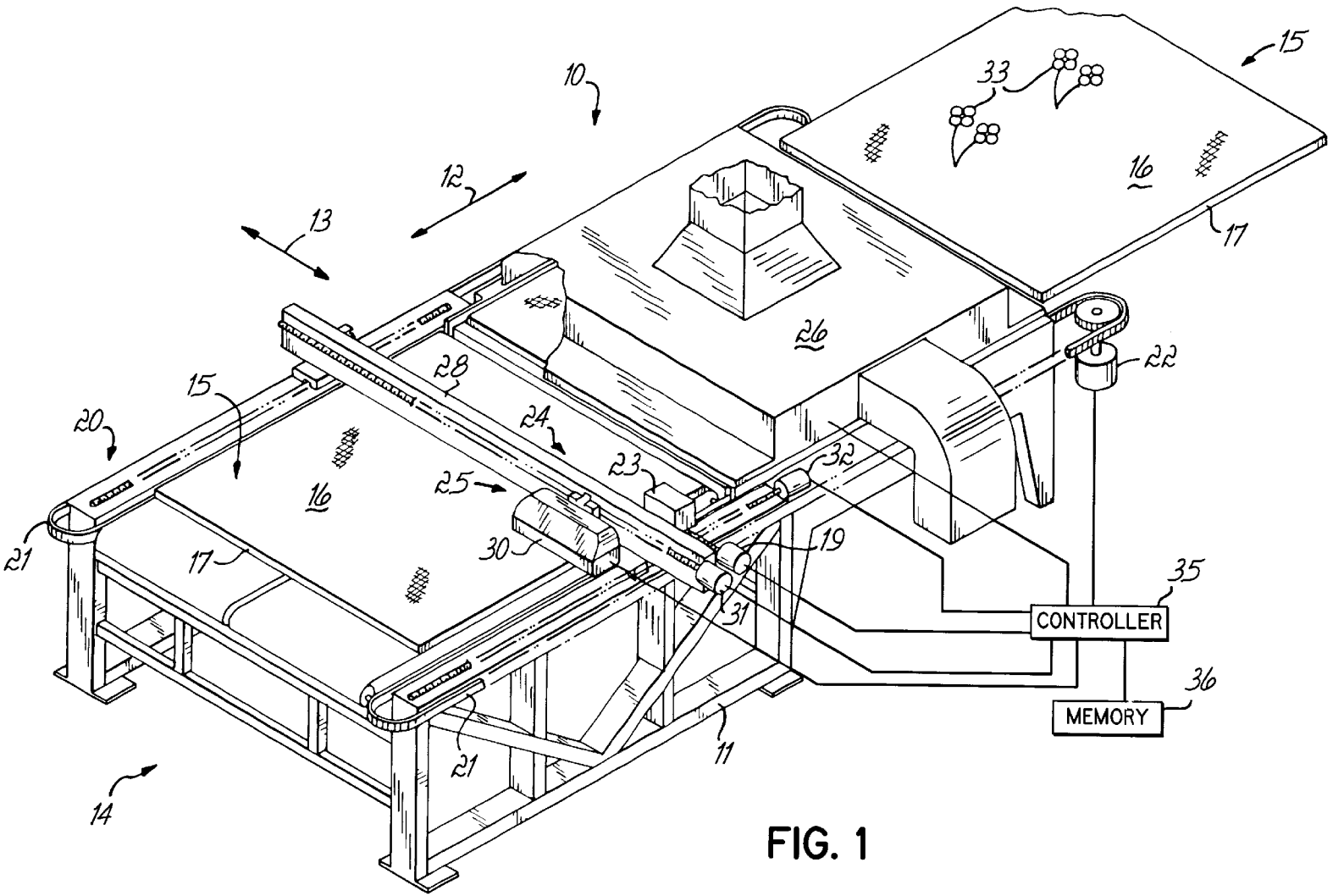
FIG. 1 is a perspective view of one embodiment of an apparatus embodying principles of the present invention in which ink jet printing is applied to panels of rigid office partitions that are covered with textured or contoured textile material or fabric.

FIG. 1 illustrates a machine 10 for printing onto rigid panels. The machine 10 includes a stationary frame 11 with a longitudinal extent represented by an arrow 12 and a transverse extent represented by an arrow 13. The machine 10 has a front end 14 into which is advanced a rigid panel 15, such as that of which an office partition may be formed. The panel 15 may include a metal or wooden frame 17 on which is stretched a facing material that forms the surface 16 to be printed. The surface 16 may also be a flat but highly textured fabric, a molded material such as a foam or some other contoured or variable surface. Panels 15 are carried longitudinally on the machine 10 by a conveyor or conveyor system 20, formed of a pair of opposed pin tentering belt sets 21 which extend through the machine 10 and onto which the panels 15 are fed at the front end 14 of the machine 10. The belt sets 21 retain the panels 15 in a precisely known longitudinal position on the belt sets 21 to carry the panels 15 through the longitudinal extent of the machine 10, preferably with an accuracy of ¼ inch. The longitudinal movement of the belts 21 of the conveyor 20 is controlled by a conveyor drive 22. The conveyor 20 may take alternative forms including, but not limited to, opposed cog-belt side securements, longitudinally moveable positive side clamps that engage the panels 15 or other securing structure for holding the panels 15 fixed relative to the conveyor 20.

Along the conveyor 20 are provided three stations, including an ink jet printing station 25, a UV light curing station 24, and a heated drying station 26. The printing station 25 includes an ink jet carriage having one or more ink jet printing heads 30 thereon. The carriage of the print heads 30 is shown as transversely moveable on the front of a cross bar 28 that extends transversely across the frame 11 and may, but not necessarily, also be longitudinally moveable on the frame 11 under the power of a transverse servo drive motor 31 and an optional longitudinal drive 32. Alternatively, the heads 30 may extend across the width of the web 15 and be configured to print an entire transverse line of selectable points simultaneously onto the panel 15.

The ink jet printing heads 30 are configured to jet UV ink, for example, at 75 picoliters, or approximately 80 nanograms, per drop, and may do so for each of four colors according to a CMYK color pallette. The dots are preferably dispensed at a resolution of about 180 dots per inch by about 254 dots per inch. The resolution may be higher or lower as desired, but the 180×254 resolution is preferred. If desirable for finer images or greater color saturation, 300×300 dots per inch is preferable. The drops of the different colors can be side-by-side or dot-on-dot. Dot-on-dot (sometimes referred to as drop-on-drop) produces higher density.

The print heads 30 are provided with controls that allow for the selective operation of the heads 30 to selectively print designs of one or more colors onto the surface of the panel 15. The drive 22 for the conveyor 20, the drives 31,32 for the print head 30 and the operation of the print heads 30 are program controlled to print patterns 33 at known locations on the panel 15 by a controller 35, which includes a memory 36 for storing programmed patterns, machine control programs and real time data regarding the nature and longitudinal and transverse location of printed designs 33 on the panel 15 and the relative longitudinal position of the panel 15 in the machine 10.

The UV curing station 24 includes a UV light curing head 23 that may move with the print heads 30 or, as is illustrated, move independently of the print heads 30. The UV light curing head 23 is configured to sharply focus a narrow, longitudinally extending beam of UV light onto the printed surface of the fabric. The UV curing head 23 is provided with a transverse drive 19 which is controlled to transversely scan the printed surface of the fabric to move the light beam across the fabric.

Preferably, the curing head 23 is intelligently controlled by the controller 35 to selectively operate and quickly move across areas having no printing and to scan only the printed images with UV light at a rate sufficiently slow to UV cure the ink, thereby avoiding wasting time and UV energy scanning unprinted areas. If the head 23 is included in the printing station 25 and is coupled to move with the print heads 30, UV curing light can be used in synchronism with the dispensing of the ink immediately following the dispensing of the ink.

The UV curing station 24, in the illustrated embodiment, is preferably located either immediately downstream of the printing station 25, or on the print head carriage to the sides of the print heads, so that the fabric, immediately following printing, is subjected to a UV light cure. In theory, one photon of UV light is required to cure one free radical of ink monomer so as to set the ink. In practice, one joule of UV light energy per square centimeter of printed surface area is supplied by the UV curing head 23. This is achieved by sweeping a UV beam across the printed area of the fabric at a power of 300 watts per linear inch of beam width. This is sufficient to produce a UV cure of at least 90%. Increasing the UV light power up to 600 watts per linear inch can be done to achieve a 97% or better cure. Alternatively, if fabric thickness and opacity are not too high, curing light can be projected from both sides of the fabric to enhance the curing of the UV ink. Using power much higher can result in the burning or even combustion of the fabric, so UV power has an upper practical limit.

The heat curing or drying station 26 may be fixed to the frame 11 downstream of the UV light curing station or may be located off-line. With 97% UV cure, the ink will be sufficiently colorfast so as to permit the drying station to be off-line. When on-line, the drying station should extend sufficiently along the length of fabric to adequately cure the printed ink at the rate that the fabric is printed. When located off-line, the heat curing station can operate at a different rate than the rate of printing. Heat cure at the oven or drying station 26 maintains the ink on the fabric at about 300° F. for up to three minutes. Heating of from 30 seconds to three minutes is the anticipated advantageous range. Heating by forced hot air is preferred, although other heat sources, such as infrared heaters, can be used as long as they adequately penetrate the fabric to the depth of the ink.

Figure 2:
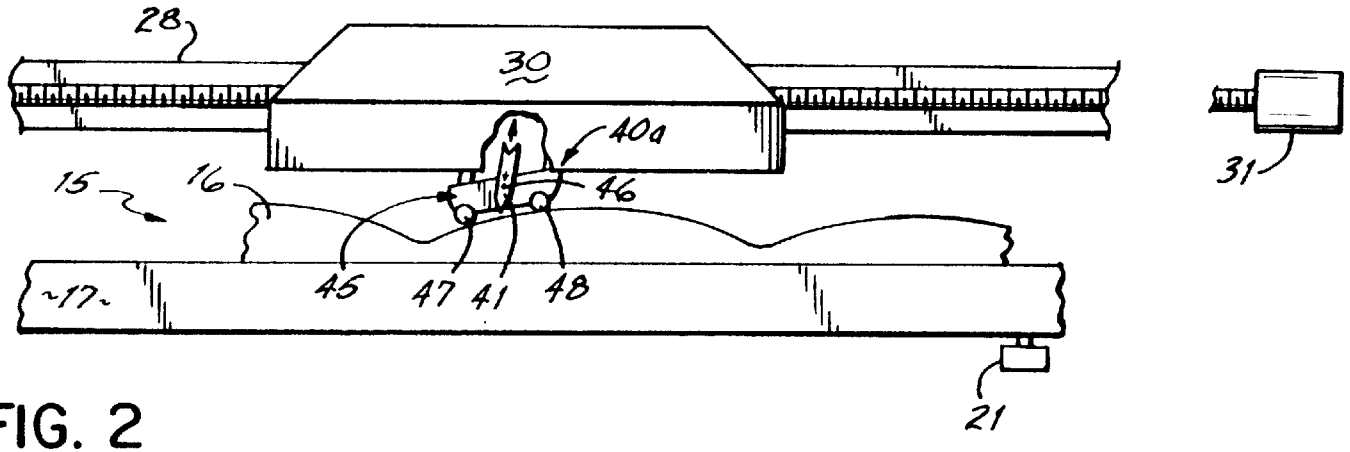
FIG. 2 is a cross-sectional view along line 2—2 of FIG. 1 showing structure for maintaining print head to substrate distance where a substrate is more highly contoured.

A quilting station may be located on-line with the printing station or off-line, and either before or after the printing station. Locating a quilting station downstream of the oven 26 is advantageous in the case of quilted comforters and mattress covers and where quilting is to be applied and registered with printing on the fabric. A single-needle quilting station may be used, such as is described in U.S. Pat. No. 5,832,849, to Kaetterhenry et al. entitled "Web-fed Chain-stitch Single-needle Mattress Cover Quilter with Needle Deflection Compensation", which is expressly incorporated by reference herein. Other suitable single-needle type quilting machines with which the present invention may be used are disclosed in U.S. Pat. Nos. 5,640,916 and 5,685,250, respectively, both entitled "Quilting Method and Apparatus", expressly incorporated by reference herein. Such a quilting station may also include a multi-needle quilting structure such as that disclosed in U.S. Pat. No. 5,154,130, also expressly incorporated by reference herein.

Where quilting, molding or other contouring of a substrate is carried out before the printing onto the substrate, registration of the printing to the pre-applied contouring will usually be desired. To register the printing to pre-applied contours, the location of the contour pattern can be calculated in relation to a reference point on the substrate that can be sensed by sensors at the printing station. The location of the pattern can be directly sensed with a sensor 40 mounted on the print head 30, as illustrated respectively as 40*a*, 40*b* in FIGS. 2 and 2A. The print head 30 includes a nozzle or ink jet nozzle array 41 that is directed downward toward the upwardly facing surface 16 of a substrate such as the panel 15. The panel 15 may have, for example, depressions or channels 43 on its surface 16 that have been formed by stitching or molding, as illustrated in FIG. 2. The sensor 40 measures the distance from the nozzle 41 to the surface 16. Information from the sensor 40 can be communicated to the controller 35 and correlated with the longitudinal and transverse position information of the print head 30 and interpreted to determine the location of the contoured pattern so that the printed image can be applied to the surface 16 in registration with the pre-applied contour pattern.

In the embodiment of FIG. 2, the sensor 40 is a mechanical sensor 40*a* that includes a wheeled carriage 45. The nozzle 41 is mounted at the midpoint of the carriage 45, which is, in turn, pivotally connected to the print head 30 about a longitudinal axis 46 through the center of the carriage 45. The carriage 45 has left and right sensing wheels 47, 48, respectively, that ride on the surface 16 of the panel 15 and follow the contour. The carriage 45 moves vertically relative to the print head 30 and follows the contour of the surface 16. The nozzle 41, being midway between the wheels 47, 48, will be positioned vertically at the average of the vertical positions of the wheels 47, 48. In this way, the nozzle 41 is passively positioned at a controlled distance relative to the surface 16 of the panel 15 in response to the detected location of the surface 16 of the panel 15 as determined by the carriage 45 as the wheels 47, 48 ride on the surface 16.

The distance between the UV head 23 and the fabric is preferably also controllable so that the curing light is always precisely focused onto the printed contoured surface of the fabric. This distance may controlled by mounting the UV curing head to move with the print heads, such as by communicating the UV light through optic fibers adjacent the print heads, for example, one fiber on each side of the print heads, or by mounting the UV curing head 23 on a separate carriage and providing it with a separate distance adjusting servo motor. Separate control of the UV curing head 23 can be in response to the sensors used to measure print head distance or in response to separate sensors provided to measure curing head distance. Where the print head sensors are used to control curing head to fabric distance, a memory can be used to store a map of the surface or portion of the surface while a controller retrieves the correct distance information from the memory that corresponds to the position of the curing head over the fabric. Alternatively, the UV curing head can be fixed and the focal length of the UV light from the source automatically varied.

Figure 2A:
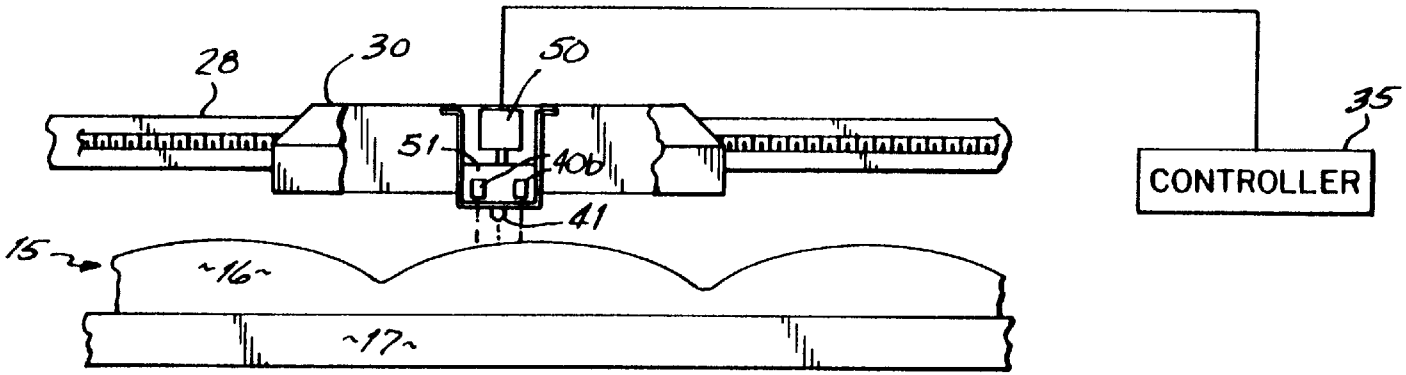
FIG. 2A is a cross-sectional view similar to FIG. 2 showing alternative structure for maintaining print head to substrate distance.

Whether the panel 15 has a contoured pattern on its surface 16 or merely a textured material, print quality is maintained by maintaining precise spacing between the nozzle 41 and the surface 16 of the panel 15. FIG. 2A illustrates a rigid panel 15 having its outer upwardly facing surface 16 covered with a coarse woven or textured fabric. As the print head 30 moves transversely on the cross bar 28, the vertical position, relative to the print head 30, of the point on the surface 16 of the panel 15 at which the nozzle 41 is directed varies, often one or more millimeters. To measure such distance variations, an optical or laser sensor 40*b* is provided either on the print head 30 or on the carriage at a fixed height from the plane of support of the fabric. The sensor 40*b* instantaneously measures the distance from the nozzle 41 to the surface 16 of the panel 15 and communicates the measurement to the controller 35. The nozzle 41 is mounted on an output actuator 51 of a servo motor 50 mounted in the print head 30. The controller 35 sends a control signal to the servo motor 50 to move the nozzle 41 on the print head 30 vertically in response to the distance measurement from the sensor 40*b* to maintain a constant distance from the nozzle 41 to the surface 16 of the panel 15.

Printing on rigid panels, even where the surface is not textured or contoured, can benefit from the sensing and adjustment of the distance from print nozzle to surface of the panel since the rigid frame of the panel and the thickness of the panel when supported on the frame of a printing apparatus makes the position of the upper surface of the panel unpredictable.

Figure 1A:
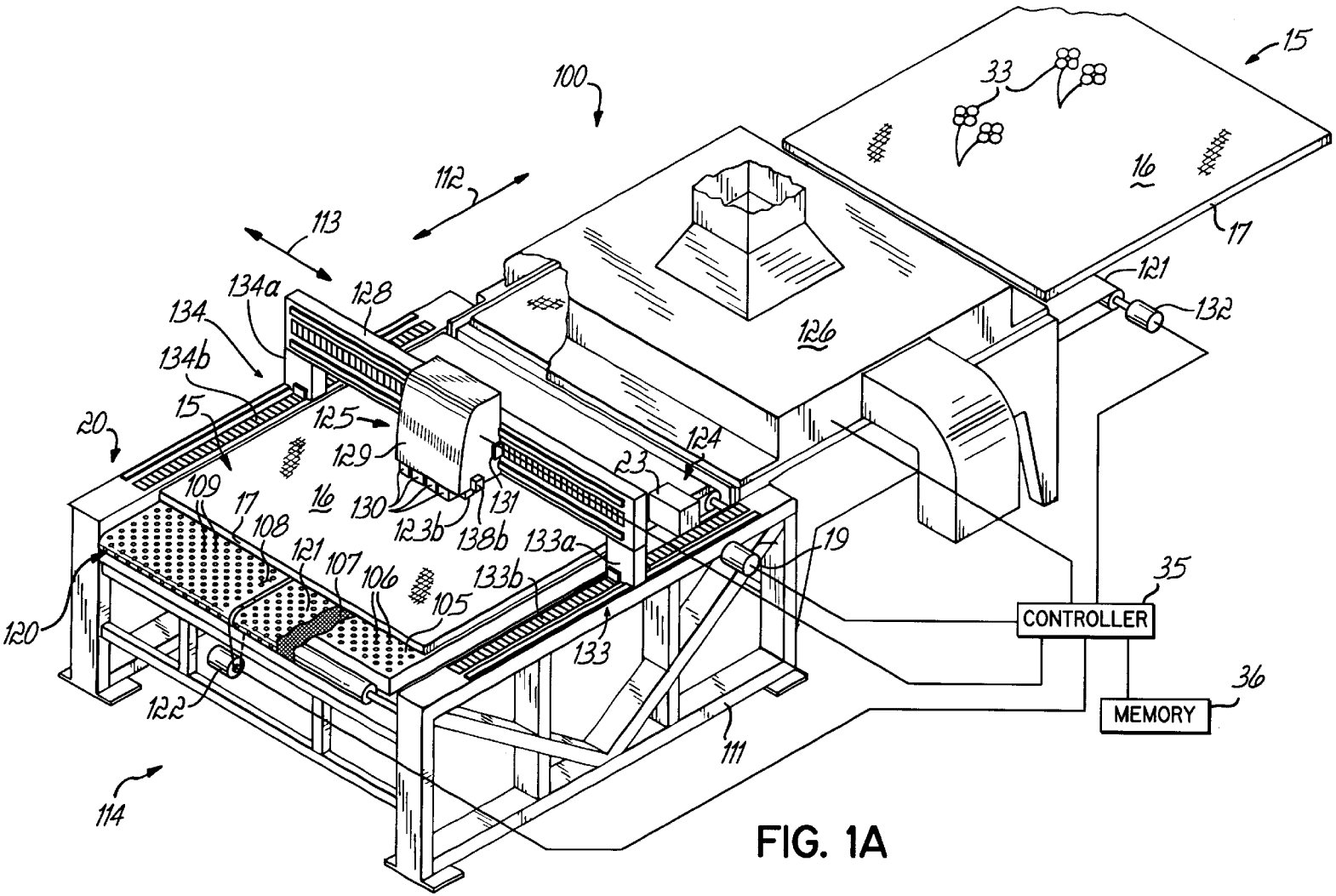
FIG. 1A is a perspective view, similar to FIG. 1, of another embodiment of an apparatus embodying principles of the present invention in which ink jet printing is applied to rigid panels.

FIG. 1A illustrates an alternative embodiment 100 of the machine 10 described above. The machine embodiment 100 includes a stationary frame 111 with a longitudinal extent represented by an arrow 112 and a transverse extent represented by an arrow 113. The machine 100 has a front end 114 into which the rigid office partition panel 15 may be loaded onto a belt 121 of a conveyor system 120 having one or more flights which carry the panel 15 longitudinally through the machine 100. The belt 121 of the conveyor 120 extends across the width of the frame 111 and rests on a smooth stainless steel vacuum table 105, which has therein an array of upwardly facing vacuum holes 106 which communicate with the underside of the belt 121. The belt 121 is sufficiently porous that the vacuum from the table 105 communicates through the belt 121 to the underside of the rigid panel 15 to assist gravity in holding the panel 15 in place against the top side of the belt 121. Preferably, the belt 121 has a high friction rubber-like surface 108 to help prevent a horizontal sliding of a panel resting on it, through which an array of holes 109 is provided to facilitate communication of the vacuum from the table 105 to the substrate.

The top surface of the belt 121 of the conveyor 120 is such that it provides sufficient friction between it and the underside of the panel 15 to keep the panel 15 from sliding horizontally on the conveyor 120. The conveyor 120 is further sufficiently non-elastic so that it can be precisely advanced. To this end, the belt 121 has a non-elastic open weave backing 107 to provide dimensional stability to the belt while allowing the vacuum to be communicated between the holes 106 of the table 105 and the holes 109 in the surface of the belt 121. The forward motion of the panel 15 on the frame 111 is precisely controllable by indexing of the belt 121 by control of a servo drive motor 122 with signals from the controller 35. The belt 121 thereby retains the panels 15 in a precisely known longitudinal position on the belt 121 so as to carry the panels 15 through the longitudinal extent of the machine 100. Such indexing of the belt 121 should be controllable to an accuracy of about 0.0005 inches where used to move the panel 15 relative to a print head on a fixed bridge (which embodiment is not shown).

In the embodiment 100 illustrated in FIG. 1A, the longitudinal movement of the belt 121 of the conveyor 120 is controlled by the conveyor drive 122 to move the panel into printing position and then to advance it downstream after it is printed. One or more additional separately controllable drives 132 may be provided to control the downstream flights, if any, of the conveyor 120.

Along the length of travel of the conveyor 120 are provided three stations, including an ink jet printing station 125 and one or more curing or drying stations, which may include UV light curing stations 124 and/or a heating station 126. The printing station 125 includes a bridge 128. Where the belt 121 is operable to precisely index the panel 15 relative to the bridge 128, the bridge may be fixed to the frame 111 and extend transversely across it. A printhead carriage 129 is transversely moveable across the bridge 128 and has one or more sets 130 of ink jet printing heads thereon. The carriage 129 is preferably fixed to the armature of a linear servo motor 131 which has a linear array of stator magnets extending transversely across the bridge 128, so that the carriage 129 is transversely moveable across the bridge 128 by positioning and drive control signals sent to the servo 131 by the controller 35, described above.

In the illustrated embodiment, the bridge 128 is mounted to the moveable armatures 133*a*, 134*a* that ride on longitudinal tracks 133*b*, 134*b* of linear servo motors 133, 134 at each side of the conveyor 120. Once a panel 15 is positioned under the bridge 128 by movement of the belt 121, the bridge 128 is indexed in the longitudinal direction as transverse bands of an image are printed in successive scans of print heads 130, described below. This indexing should be as accurate as needed to insure that the scans register one with another and can be interlaced, as required, to produce the desired print quality and resolution. Such accuracy is preferred to be about 0.0005 inches. Lower resolution, and thus less accuracy, is acceptable for printing on textile surfaces than on smoother surfaces such as vinyl.

Figure 3:
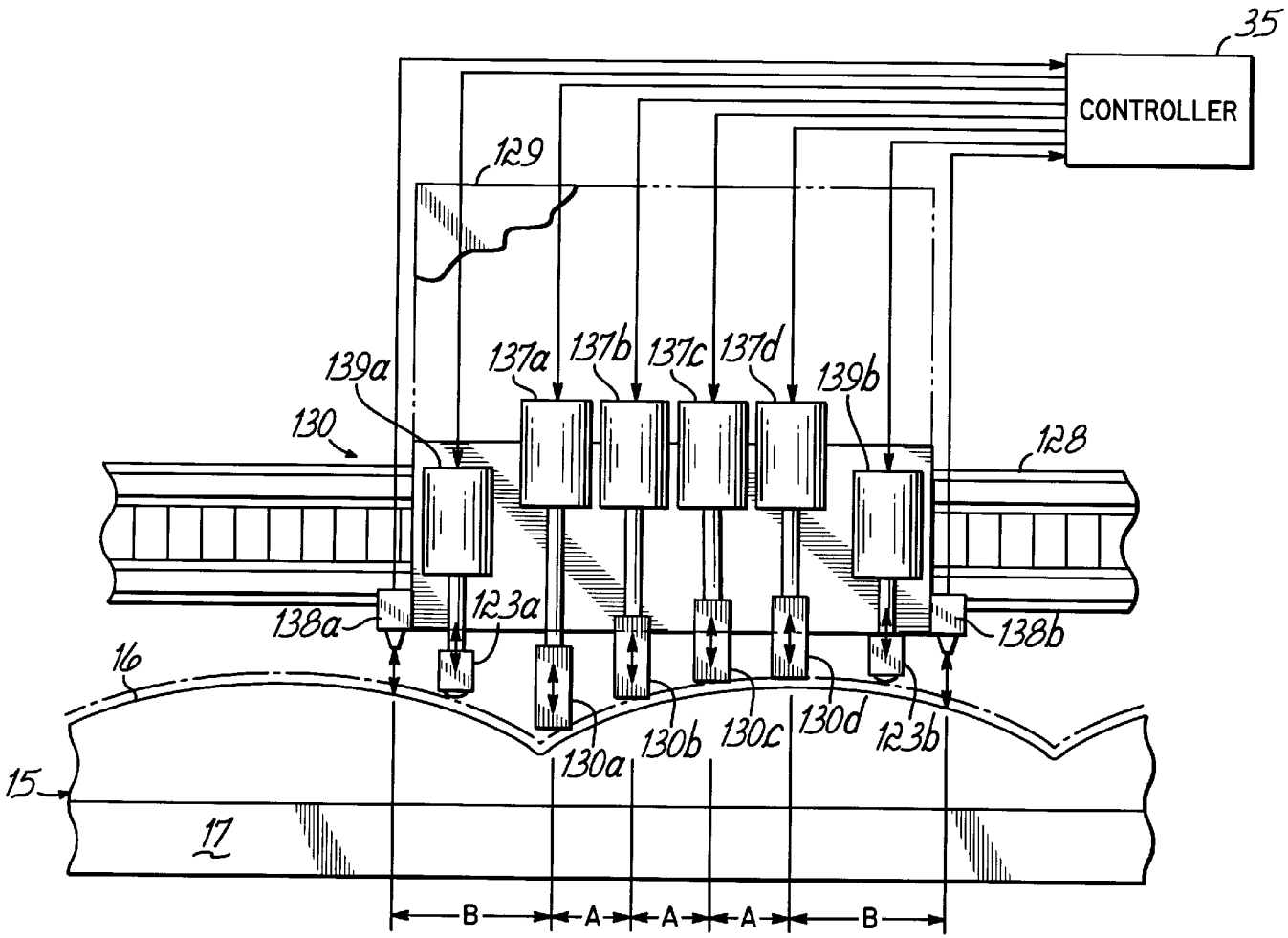
FIG. 3 is a cross-sectional view along line 3—3 of FIG. 1A showing structure for maintaining print head to substrate distance on a contoured substrate.

FIG. 3 illustrates a set 130 of four ink jet printing heads 130*a*–130*d* configured to respectively apply the four colors of a CMYK color set. The ink jet printing heads 130*a–d* each include a linear array of one hundred twenty-eight (128) ink jet nozzles that extend in the longitudinal direction relative to the frame 111 and in a line perpendicular to the direction of travel of the carriage 129 on the bridge 128. The nozzles of each of the heads 130 are configured and controlled to simultaneously but selectively jet UV ink of one of the CMYK colors side by side across the substrate 15, and to do so in a series of cycles as the nozzles scan the substrate 15. The heads 130*a–d* of a set are arranged side-by-side to print consecutively across the same area of the substrate 15 as the carriage 129 moves across the bridge 128, each depositing one of the four colors sequentially on each dot position across the substrate 15.

Each of the heads 130*a–d* is moveably mounted to the carriage to individually move vertically, or perpendicular to the plane of the substrate 15. The distance of each head 130*a–d* from the plane of the substrate 15 is controlled by a respective one of a set of servos 137*a–d* mounted to the carriage 129 to follow one behind the other over the same contour of the substrate 15. The servos 137*a–d* are responsive to signals from the controller 35 which controls the positions of the heads 130*a–d* to maintain each a controlled distance from the surface of the substrate 15 where the surface 16 of the substrate 15 is contoured.

Usually, it is desirable to maintain the heads a fixed distance from the surface 16 on which they are to print. This is achieved by providing optical sensors 138*a*, 138*b* on the opposite transverse sides of the carriage 129. The printhead set 130 is bidirectional and prints whether moving to the right or to the left. As the print head carriage 129 moves on the bridge 128, the leading one of the sensors 138*a* or 138*b* measures the distance from the sensor 138 and the surface 16 of the substrate 15 at a point directly in line with, typically directly below, the sensor 138. This measurement is communicated to the controller 35, which records the measured distance and the coordinates on the surface 16 of the substrate 15 at which the measurement was taken. These coordinates need only include the transverse position on the substrate 15 where the information is to be used in the same pass or scan of the carriage in which the measurement was taken. However, the controller 35 may also record the longitudinal coordinate by taking into account the position of the panel 15 on the frame 111 relative to the bridge 128.

In response to the measurements, the controller 35 controls the servos 137 to vertically position the each of the heads 130 to a predetermined distance from the contoured surface 16 of the substrate 15 as the respective head arrives at the transverse coordinate on the substrate 15 at which each measurement was taken. As a result, the nearest of the heads 130 to the leading sensor 138, which are spaced a distance B from the sensor 138, follows the contour of the fabric at a delay of V/B seconds after a given measurement was taken, where V is the velocity of the carriage 129 on the bridge 128. Similarly, the heads 130 are spaced apart a distance A and will each sequentially follow the same contour as the first head at V/A seconds after the preceding head.

The extent of the heads 130 in the longitudinal direction determines the accuracy with which the heads can follow the contours of the substrate 15. Greater accuracy can be maintained, and more variable contours can be followed, by using narrower heads, for example, of 64 or 32 jets per head in the longitudinal direction. Accordingly, multiple sets of heads 130 can be arranged in a rectangular or other array on the carriage 129, with heads of the different sets being arranged side-by-side across the carriage 129 in the longitudinal direction of the substrate 15 and frame 111. For example, two sets of heads having 64 jets per head each or four sets of heads having 32 jets per head each will produce the same 128 dot wide scan, but with greater ability to maintain spacing from head to substrate where the contours vary in the longitudinal direction on the substrate 15.

Where UV curable ink is used, the UV curing station 124 is provided as illustrated in FIG. 1A. It may include a printhead 23 transversely moveable independently of the print heads 130 across the downstream side of the bridge 128 or otherwise located downstream of the printing station 125, and/or may include UV light curing heads 123*a* and 123*b* mounted on the carriage 129. As the carriage 129 moves transversely on the bridge 128, only the curing head 123*a*, 123*b* that trails the print heads 130 is operated so that the UV light exposes ink after its deposition onto the substrate 15. The curing heads 123*a*, 123*b* may also be moveable toward and away from the plane of the substrate 15 and controllable by servos 139*a*, 139*b*, respectively, to maintain their spacing from the surface 16, as illustrated in FIG. 3. Proper curing of UV ink requires that the UV light be focused on the surface bearing the ink. Therefore, moving the UV heads 123*a*, 123*b* to maintain a constant spacing from the surface 16 maintains the focus of the curing UV light. UV light curing heads are typically configured to sharply focus a narrow, longitudinally extending beam of UV light onto the printed surface. Therefore, instead of physically moving the UV light curing heads or sources 123*a*, 123*b*, the focal lengths of the light curing heads 123*a*, 123*b* may be varied to follow the contours of the substrate 15. The light curing head 123, where used, may similarly be configured to move perpendicular to the surface 16 of the substrate 15.

The heat curing or drying station 126 may be fixed to the frame 111 downstream of the printing station 125 and the UV light curing station, if any, may be located off-line. Such a drying station 126 may be used to dry solvent based inks with heated air, radiation or other heating techniques. It may also be used to further cure or dry UV inks.

Printing on rigid panels, even where the surface is not textured or contoured, can benefit from the sensing and adjustment of the distance from print nozzle to surface of the panel since the rigid frame of the panel and the thickness of the panel when supported on the frame of a printing apparatus makes the position of the upper surface of the panel unpredictable.

The above description is representative of certain preferred embodiments of the invention. Those skilled in the art will appreciate that various changes and additions may be made to the embodiments described above without departing from the principles of the present invention. Therefore, the following is claimed:

What is claimed is:

1. A method of printing on a substrate comprising:

moving a print head carriage, having a plurality of ink jet print heads thereon, parallel to a plane in which is supported a substrate having a surface that varies relative to said plane; then separately adjusting the distances from each of the print heads to the plane to position each of the heads at a respective predetermined distance from the surface of the substrate onto which ink is to be jetted from the heads;

jetting ink from the heads, at their adjusted distances from said plane, across the respective predetermined distances onto the surface of the substrate; then further moving the print head carriage parallel to the plane while the substrate is supported therein; then separately readjusting the distances from each of the print heads to the plane to reposition each of the heads to maintain the respective predetermined distance from the surface that varies relative to the plane; and further jetting ink from the heads, at their readjusted distances from said plane, across the respective predetermined distances onto the surface of a substrate.

2. The method of claim 1 wherein:

the ink is UV curable ink; and the method further comprises at least partially curing the ink jetted onto the surface by exposing the jetted ink to ultraviolet light from a light source mounted on a carriage that moves parallel to said plane.

3. The method of claim 2 wherein:

the exposing of the ink includes adjusting the distance of the UV light from a light source to said plane, separately of the adjustment of the distances of the print heads from said plane, to focus the UV light onto the surface that bears the jetted ink as the carriage is moved parallel to said plane and across the surface that varies.

4. The method of claim 2 wherein:

the exposing of the ink includes adjusting the focal length from a source of the UV light onto the surface that bears the jetted ink to maintain the focus of UV light thereon as the carriage is moved parallel to said plane and across the surface varies.

5. The method of claim 1 wherein:

the ink is UV curable ink;

the method further comprises at least partially curing the ink jetted onto the surface by exposing the jetted ink to ultraviolet light and then heating the surface having the at least partially cured ink thereon to reduce the content of unpolymerized monomers of the ink on the substrate.

6. The method of claim 5 wherein the heating includes flowing heated air onto the surface of the substrate having the at least partially cured UV light cured ink thereon to remove uncured components of the ink from the substrate.

7. The method of claim 1 further comprising the steps of thereafter:

combining one or more secondary layers of material with the substrate; and quilting a quilted pattern on the combined layers of material and substrate in coordination with the pattern printed on the substrate.

8. The method of claim 7 further comprising the steps of:

combining the one or more secondary layers of material with the substrate and quilting the combined layers of material and substrate; then registering the surface where the ink is to be jetted with contours of the quilted substrate and performing the printing step by printing onto the substrate in registration with the quilted pattern.

9. The method of claim 7 further comprising the steps of:

combining the one or more secondary layers of material with the substrate, and quilting the combined layers of material and substrate; then sensing the contours of the quilted substrate and performing the printing step by printing onto the substrate at points determined in response to the sensing of the contours.

10. The method of claim 9 further comprising the steps of:

the adjusting of the distance from the print heads to the plane is in response to the sensing of the contours of the substrate.

11. The method of claim 1 further comprising:

sensing the position of the surface of the substrate onto which ink is to be jetted; and the adjusting of the distance from the print heads to the plane is in response to said sensing of the position of the surface that varies.

12. The method of claim 11 wherein:

the sensing of the position is carried out while moving the print head carriage; and the adjusting of the distances of each print head to said plane includes varying the position of the print heads relative to the plane as the print head carriage moves so as to maintain the respective predetermined distance of each of the print heads from the surface of the substrate in response to the sensed position.

13. A method of printing on rigid panels comprising the steps of:

moving parallel to a rigid panel a print head carriage having a plurality of ink jet print heads thereon directed toward a surface of the panel;

automatically and separately adjusting the positions of each of the print heads toward and away from the panel, as the carriage is moving parallel to the panel, to maintain a respective predetermined distances between the print heads and the surface of the panel onto which surface ink is jetted from the print heads; and while moving the print head carriage and adjusting the positions of the print heads, jetting ink from the print heads across the predetermined distance and onto the surface of the rigid panel.

14. The method of claim 13 wherein:

the surface of the panel onto which the ink is jetted varies across the panel in its distance from the carriage; and the adjusting includes separately varying the positions of each of a plurality of the print heads relative to the carriage as the carriage is moved so as to maintain the respective predetermined distances between the print heads and the surface of the panel onto which the ink is jetted.

15. The method of claim 14 further comprising:

sensing, from the print head carriage, the distance to the surface of the panel where ink is to be jetted; and separately varying the positions of a plurality of the print head relative to the print head carriage in response to the sensed distance to maintain the distance across which ink is jetted at the respective predetermined distances.

16. The method of claim 14 further comprising:

sensing the contour of the surface of the panel; and moving the carriage parallel to the panel to locations determined in response to the sensed contour and jetting the ink onto the surface of the panel at said locations.

17. The method of claim 13 wherein:

the ink is UV curable ink;

the method further comprises at least partially curing the ink jetted onto the surface by exposing the jetted ink to ultraviolet light.

18. The method of claim 17 wherein:

the exposing includes focusing UV light from a light source while moving the light source to maintain the focus of the UV light onto the surface that bears the jetted ink.

19. The method of claim 17 wherein:

the exposing includes adjusting a UV light source to maintain the focus of the UV light onto the surface that bears the jetted ink.

20. An apparatus for printing on three-dimensional surfaces of substrates comprising:

a substrate support defining a substrate supporting plane;

a print head track extending parallel to the plane;

a plurality of ink jet print heads each supported to move on the track parallel to the plane and directed toward the surface of a substrate supported by the substrate support;

a sensor operable to determine a location on the surface of the substrate; and the print heads being separately and selectively moveable perpendicular to the plane in response to the sensor to respective predetermined distances from the determined location on the surface of the substrate; and a controller operable to separately move and control each of the print heads to print on the substrate by jetting ink from the print heads across the respective predetermined distances and onto of a substrate.

21. The apparatus of claim 20 further comprising:

a UV light curing head positioned so as to expose to UV light ink jetted onto the surface of a substrate by the print head.

22. The apparatus of claim 21 wherein:

the UV light curing head is moveable relative to the plane; and the controller is operable to move the curing head to maintain focus of UV light from the curing head on ink jetted onto the surface of the substrate.

23. The apparatus of claim 21 further comprising:

a heating station positioned so as to heat UV light exposed ink on a substrate.

24. The apparatus of claim 23 wherein:

the heating station includes a blower oriented to direct heated air onto a substrate on the support.

25. An apparatus of claim 20 further comprising:

a quilting station positioned to quilt the substrate to impart a contour to the surface of the substrate.

26. The apparatus of claim 20 wherein:

the sensor is a non-contact, distance-measuring device that includes a light source and light detector mounted on the track.

27. The apparatus of claim 20 wherein:

the sensor is a non-contact, distance-measuring device that includes a light source and light detector mounted on the track; and the track has further mounted thereon a plurality of servo motors, each responsive to an output signal from the sensor, to adjust the position of the print heads relative to the substrate to control the distance across which ink is jetted during printing.

28. The apparatus of claim 20 wherein:

the sensor includes moveable mechanical elements that maintain contact with the surface of the substrate; and the print heads are linked to the mechanical elements so as to move in response thereto.

29. The apparatus of claim 20 wherein:

the plurality of ink jet print heads includes a plurality of individually moveable print heads spaced in the direction of movement of the carriage so as to sequentially pass over the same areas of the substrate, each printing one of a set of colors thereon;

the print heads are separately and selectively moveable toward and away from the plane; and a controller operable to control the print heads in response to the sensor to sequentially follow the contour of the substrate surface as the carriage moves across the substrate to maintain a constant distance of travel of ink from each print head to the surface of the substrate.

30. The apparatus of claim 29 wherein:

the plurality of ink jet print heads includes a plurality of sets of individually moveable print heads arranged side-by-side on the carriage perpendicular to the direction of movement of the carriage so that each can maintain a controlled spacing from the substrate where the contour of the substrate varies in the direction perpendicular to the movement of the carriage.

31. The apparatus of claim 20 wherein:

the plurality of ink jet print heads includes a plurality of individually moveable print heads arranged side-by-side on the carriage perpendicular to the direction of movement of the carriage so that each can maintain a controlled spacing from the substrate where the contour of the substrate varies in the direction perpendicular to the movement of the carriage.

32. A method of printing on a substrate comprising automatically separately adjusting the position of each of a plurality of ink jet print heads applying ink onto the substrate such that a uniform distance is maintained across which ink is jetted between each respective print head and the substrate during printing.

33. The method of claim 32 further comprising:

measuring the distance between the substrate and each print head; and separately adjusting the position in response to the measuring of the distance.

34. The method of claim 32 further comprising separately adjusting the position of each print head and applying a different color of ink with different ones of the print heads.

* * * * *

UNITED STATES PATENT AND TRADEMARK OFFICE

CERTIFICATE OF CORRECTION

PATENT NO. : 6,523,921 B2 
DATED : February 25, 2003
INVENTOR(S) : Richard N. Codos It is certified that error appears in the above-identified patent and that said Letters Patent is hereby corrected as shown below:

Column 3,
Line 51, after “fabric,” delete “providing”.

Column 7,
Line 9, after “This distance may” insert -- be --.

Column 9,
Line 46, after “to vertically position” delete “the”.

Column 11,
Line 27, after “across the surface” insert -- that --.

Column 12,
Line 26, after “maintain” delete “a”.
Lines 46-47, after “a plurality of the print” delete “head” and insert therefor -- heads --.

Column 13,
Line 23, after “predetermined distances and onto” delete “of”.

Column 14,
Line 48, after “each print head; and” a new paragraph break should be inserted beginning with the word “separately”.

Signed and Sealed this

Thirtieth Day of September, 2003

JAMES E. ROGAN
*Director of the United States Patent and Trademark Office*